US009138063B1

(12) United States Patent
Newman

(10) Patent No.: US 9,138,063 B1
(45) Date of Patent: Sep. 22, 2015

(54) COLLAPSIBLE ROTATING SEAT

(71) Applicant: Patrick Spruce Newman, Katy, TX (US)

(72) Inventor: Patrick Spruce Newman, Katy, TX (US)

( * ) Notice: Subject to any disclaimer, the term of this patent is extended or adjusted under 35 U.S.C. 154(b) by 0 days.

(21) Appl. No.: 14/170,946

(22) Filed: Feb. 3, 2014

Related U.S. Application Data

(60) Provisional application No. 61/761,691, filed on Feb. 6, 2013.

(51) Int. Cl.

| | |
|---|---|
| ***A47C 4/00*** | (2006.01) |
| ***A47C 4/10*** | (2006.01) |
| ***A47C 4/12*** | (2006.01) |
| ***A47C 15/00*** | (2006.01) |
| ***A47C 3/18*** | (2006.01) |
| ***A47C 4/04*** | (2006.01) |

(52) U.S. Cl.
CPC ..... *A47C 15/008* (2013.01); *A47C 3/18* (2013.01); *A47C 4/04* (2013.01)

(58) Field of Classification Search
USPC ..... 297/53, 54, 183.1, 183.5, 183.6, 183.9, 297/344.18, 344.21; 5/929, 81.1 RP, 5/503.1–507.1, 658
See application file for complete search history.

(56) References Cited

U.S. PATENT DOCUMENTS

| | | | | |
|---|---|---|---|---|
| 896,179 | A * | 8/1908 | Vance et al. | 297/87 |
| 2,876,825 | A * | 3/1959 | Boortz | 297/54 X |
| 3,104,139 | A * | 9/1963 | Thompson | 297/344.21 X |
| 3,718,365 | A * | 2/1973 | Gibson | 297/344.24 |
| 3,971,592 | A * | 7/1976 | Farley | 5/929 X |
| 4,253,203 | A * | 3/1981 | Thomas | 4/559 |
| 4,544,202 | A * | 10/1985 | Keaton | 297/344.22 |
| 5,078,451 | A * | 1/1992 | Sobel | 297/344.26 |
| 5,311,622 | A * | 5/1994 | Allen | 5/81.1 RP |
| 5,381,569 | A * | 1/1995 | Church | 5/81.1 RP |
| 5,567,014 | A * | 10/1996 | Fitch | 297/344.21 |
| 5,740,563 | A * | 4/1998 | Gaddy | 297/344.21 X |
| 5,822,809 | A * | 10/1998 | Gallo | 4/578.1 |
| 5,903,935 | A * | 5/1999 | Huelke | 4/560.1 |
| 5,971,480 | A * | 10/1999 | Maschke | 5/929 X |
| 6,199,552 | B1 * | 3/2001 | Crespo | 5/929 X |
| 6,256,806 | B1 * | 7/2001 | DiTommaso | 4/560.1 |
| RE37,927 | E * | 12/2002 | Fitch | 297/344.21 |
| 7,121,620 | B1 * | 10/2006 | Fang | 297/51 |
| 8,480,173 | B2 * | 7/2013 | Huang | 297/344.21 X |
| 2008/0265642 | A1 * | 10/2008 | Moyers | 297/344.21 |
| 2010/0038934 | A1 * | 2/2010 | Bennett et al. | 297/344.21 X |
| 2010/0319121 | A1 * | 12/2010 | Polomsky et al. | 5/81.1 RP |

FOREIGN PATENT DOCUMENTS

| | | | | |
|---|---|---|---|---|
| DE | 10 2010 019 694 | A1 * | 11/2011 | A61H 19/00 |

* cited by examiner

*Primary Examiner* — Rodney B White
(74) *Attorney, Agent, or Firm* — Boisbrun Hofman, PLLC

(57) ABSTRACT

The present disclosure introduces various embodiments of a collapsible rotating seat, as well as methods of assembly and use thereof. The seat includes a frame, a first support rotatably coupled to the frame and rotatable around a first axis, and a second support rotatably coupled to the frame and rotatable around a second axis. A seating member is rotatably coupled to the frame and rotatable around a third axis that is non-parallel to at least one of the first and second axes. The seating member includes an opening through which the third axis extends.

18 Claims, 13 Drawing Sheets

COLLAPSIBLE ROTATING SEAT

CROSS-REFERENCE TO RELATED APPLICATIONS

This application claims the benefit of U.S. Provisional Application No. 61/761,691, entitled "COLLAPSIBLE ROTATING SEX SEAT," filed Feb. 6, 2013, the entire disclosure of which is hereby incorporated herein by reference.

BACKGROUND OF THE DISCLOSURE

It is well known that sexual activity is an integral part of life for most adult couples. In addition to its primary utility in facilitating procreation, sex is extremely important for its other benefits such as emotional connection between partners, improved self-esteem, exercise, stress relief, numerous health benefits, and pleasure. Many devices and products have been developed to enhance sex.

One such device, commonly known as a spinning sex swing, includes a fabric seating element having a centrally disposed hole and suspended from a fixed point, such as a ceiling hook or an accompanying stand that may be disassembled for storage. However, use of the ceiling hook may damage the ceiling, may detract from the aesthetic appearance of the room in which it is installed, and the need for an adequate load bearing structure may limit possible installation sites. The ceiling hook may also present a potential safety risk should it disengage while in use. The accompanying stand requires time and effort for assembly/disassembly as well as additional space and weight when not in use.

Moreover, because sex is an intimate act, it is normally performed in a private setting, and social conventions generally impose a desire to keep sex products concealed from view when not in use. However, devices like the swing described above are difficult to adequately conceal.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
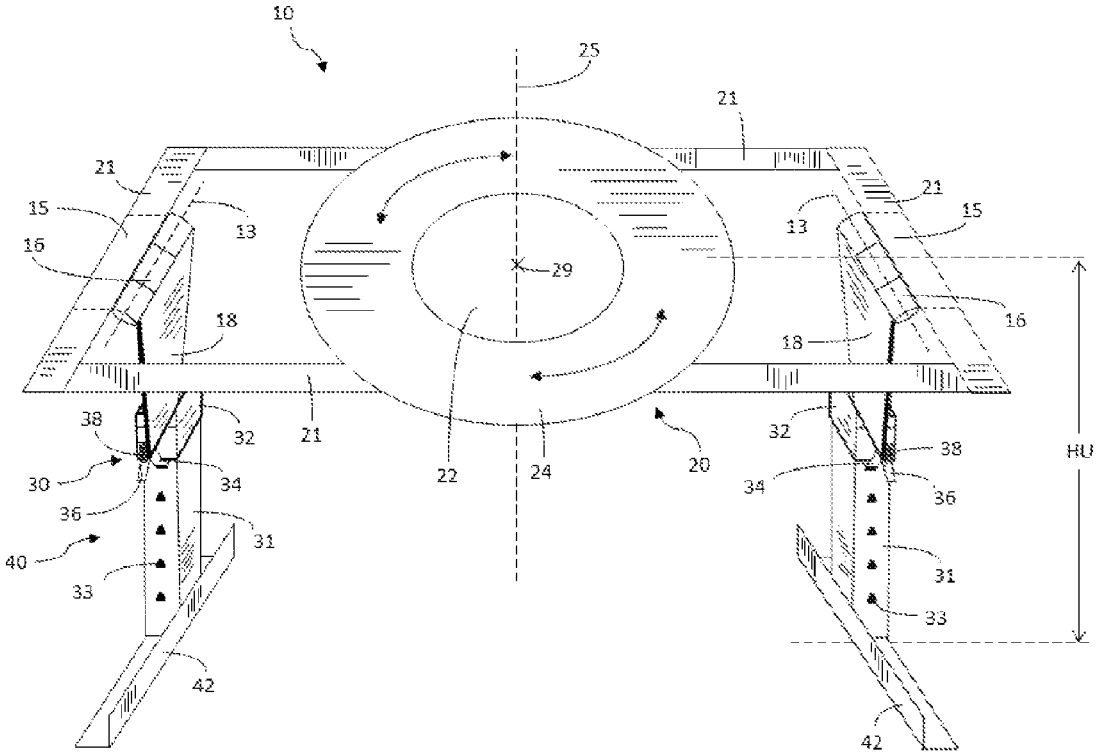
FIG. 1 is a perspective view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Figure 2:
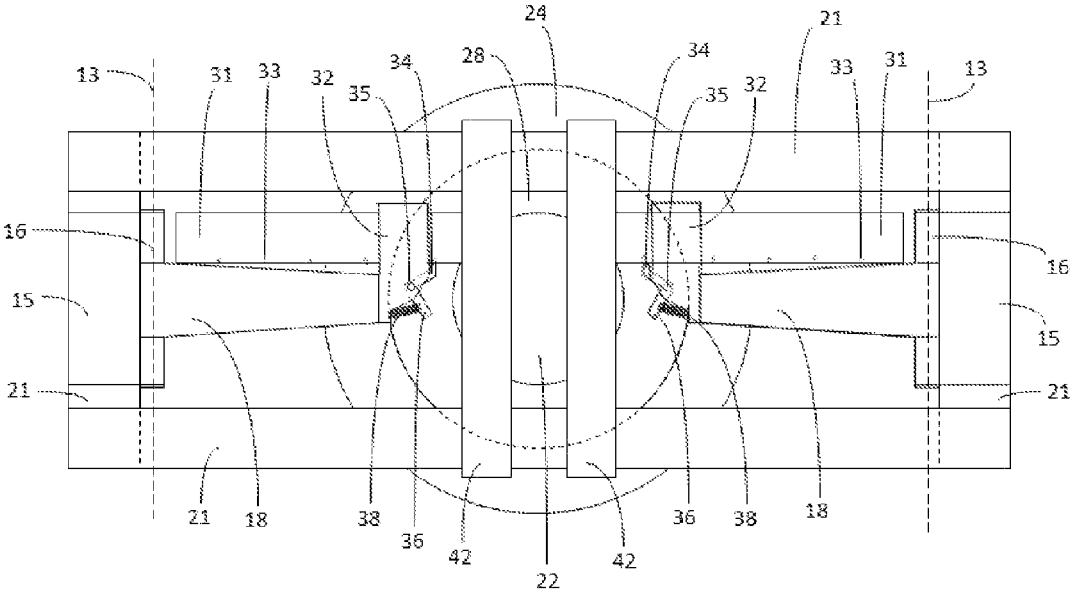
FIG. 2 is a bottom view of apparatus shown in FIG. 1 in a collapsed position.

FIGS. 1 and 2 depict at least a portion of a collapsible, rotating seat apparatus 10 according to one or more aspects of the present disclosure. The apparatus 10 may comprise a frame 21 rotatably coupled to a seating member 20, where the rotational axis 25 of the seating member 20 may be substantially vertical such that the seating member 20 may be rotated in a substantially horizontal plane. It should be noted that the rotational axis 25 of the seating member 20 need not be perfectly vertical, and such a configuration might permit rotation of the seating member 20 in a slightly non-horizontal plane, such as may vary from horizontal by up to about ten degrees. The seating member 20 may be annular in shape with an opening 22 in a central area thereof, such that the rotational axis 25 of the seating member 20 may be aligned with the geometric center 29 of the opening 22. The seating member 20 may be elevated from the ground by first and second supports 40, which may be located on opposing sides of the apparatus 10. As used herein, the term "ground" indicates any surface such as a floor, bed, other furniture, etc. that may support a supinely positioned man with the apparatus 10 situated over his lower trunk. The first and second supports 40 may each be rotatably coupled to the frame 21 such that, for example, the first and second supports 40 may be rotated about axes 13 that may be substantially perpendicular to the rotational axis 25 of the seating member 20. The rotational axes 13 of the first and second supports 40 may be substantially parallel to each other. This orientation of the rotational axes 13 of the first and second supports 40 with respect to the frame 21 permits the first and second supports 40 to be rotated toward the frame 21 such that the first and second supports 40 are folded under the seating member 20 so as to decrease at least one dimension (e.g., collapsed height) of the apparatus 10 when not in use. The apparatus 10 may be positioned in the uncollapsed configuration by rotating the first and second supports 40 away from the frame. The first and second supports 40 may be adjustable in height by means of a height adjustment mechanism 30. The height adjustment mechanism 30 may function by means of telescoping components. However, other means for adjusting the uncollapsed height HU of the apparatus 10 are also within the scope of the present disclosure.

To use the apparatus 10, the man lies down on the ground in a supine position and places the apparatus 10 above his lower trunk with the first and second supports 40 in the upright position lateral to his hips. His penis is positioned through the opening 22 of the rotatable seating member 20 and into the vagina or anus of his seated partner. The seated partner may then rotate in the substantially horizontal plane about the substantially vertical axis so that the couple can experience rotary sexual stimulation. The seated partner may also lift off of the seat using his/her arms to permit a reciprocal action, such as may be typical to sexual intercourse. Similarly, the supine partner may thrust from underneath the seating member 20, provided that the length of the first and second supports 40 is adjusted appropriately. Any combination of these movements may be performed substantially simultaneously, at any desired speed, and at any desired penetration depth according to the couple's preference.

The upper surface 24 of the seating member 20 may be capable of rotating 360 degrees or more in the substantially horizontal plane relative to the frame 21. The upper surface 24 of the seating member 20 may be padded for comfort. For example, one or more of cloth, rubber, gel, foam, or air cushions may be used to provide a soft seating surface as well as thermal insulation for skin contact against a potentially cold surface. The frame 21 may also be padded to, for example, provide thermal insulation. The seating member 20 may be constructed of metal or any other rigid material that offers sufficient support thickness to bear the weight of the seated partner without appreciable deformation. Apart from this constraint, the thickness of the seating member 20 may be minimized so as to permit maximal sexual penetration. For example, the thickness may be less than about three centimeters, although other thicknesses are also considered to be within the scope of the present disclosure.

A range of sizes may be suitable for the outer diameter of the upper surface 24 of the seating member 20 and the opening 22. For example, outer diameter sizes for the upper surface 24 may range between about thirty centimeters and about sixty centimeters. This range of sizes may meet an appropriate balance between sufficient surface area to sit on and spin comfortably without causing the apparatus to become overly bulky. The opening 22 may range between about six centimeters and about thirty centimeters in diameter. The upper surface 24 of the seating member 20 need not necessarily be circular in shape. For example, the upper surface 24 could be designed to have a substantially U-shaped footprint.

As described above, the frame 21 may be elevated from the ground by the first and second supports 40 on opposing sides thereof. Hinges comprising an upper hinge piece 15, a center pivoting piece 16, and a lower hinge piece 18 may allow the first and second supports 40 to be rotated about the axes 13 with respect to the frame 21 such that the first and second supports 40 may be folded under the seating member 20 for storage and portability. The articulation of the rotational coupling of the first and/or second supports 40 may lock when the first and/or second supports 40 are rotated into the upright position (shown in FIG. 1). A latch or other mechanism (not shown) may also exist to prevent the first and second supports 40 from collapsing when the disclosed apparatus 10 is in use, or to prevent the first and second supports 40 from opening when the apparatus 10 is collapsed. When collapsed, at least one dimension of the apparatus 10 may be reduced in size. In the collapsed configuration, the smallest dimension of the apparatus 10 (e.g., collapsed height) may range between about twenty centimeters and about five centimeters, or perhaps less, depending on the materials and configuration of components selected.

The first and second supports 40 may each comprise an upper member 32, a lower member 31, and a ground brace 42 extending beneath the lower member 31. The longitudinal axes of the upper member 32 and lower member 31 may be substantially parallel and have telescopic geometry such that one of the upper member 32 or lower member 31 may slide within the other. The ground brace 42 may be oriented substantially perpendicular to at least one of the longitudinal axes of the upper member 32 or lower member 31 and may be substantially parallel to at least one of the first or second axes 13.

The bottom of the lower hinge piece 18 may be connected to the upper member 32, which may slide up or down the lower member 31 to a height above the ground that permits the desired depth of sexual penetration. The height adjustment mechanism 30 may permit the upper member 32 to be positioned at a specific height by means of a pivoting lever 35 with a pin 34 on one end that is pressed against the lower member 31 by means of a spring 38 and locked into one of several regularly spaced notches 33 along the lower member 31. The opposing side of the pivoting lever 35 includes of a small shaft 36, which can be pressed to compress a spring 38 and translate the pin 34 out of the notch 33 so that the elevation from the ground can be adjusted to another notch 33 along the lower member 31. The spacing between the notches 33 may vary, but spacing at about three centimeters may provide for a suitable balance between reasonably fine height adjustment and a limited number of notches 33 to achieve equal height alignment of the first and second supports 40.

The length of the lower hinge piece 18 may also impact the minimum possible uncollapsed height HU of the apparatus 10 since the lower member 31 may slide up the upper member 32 until it contacts the frame 21. Although there is significant variation in anterior/posterior lower trunk width from one person to another, a minimum length of the first and second supports 40 of about fifteen centimeters may be sufficient to accommodate the majority of thinner men who are sexually active. With a lower hinge piece 18 sized to accept a minimum length of the first and second supports 40 of about fifteen centimeters, a maximum length of the first and second supports 40 of about thirty centimeters is possible. Adjusting the length of the first and second supports 40 beyond about thirty centimeters for larger individuals may entail replacing the lower member 31 with another lower member 31 having a longer length. A lower member 31 of greater length will result in larger minimum and maximum uncollapsed heights HU.

The first and second supports 40 may be constructed of sufficiently rigid and strong material, such as high-strength plastic, metal, and the like. The bottom of the lower members 31 may include ground braces 42 that rest on the ground lateral to the man's hips as he lies in a supine position. The ground braces 42 may be oriented to be substantially parallel to at least one of the first or second axes 13. The shape, size, texture, and surface material of the ground braces 42 may be selected to increase friction and stability relative to the ground.

Figure 3:
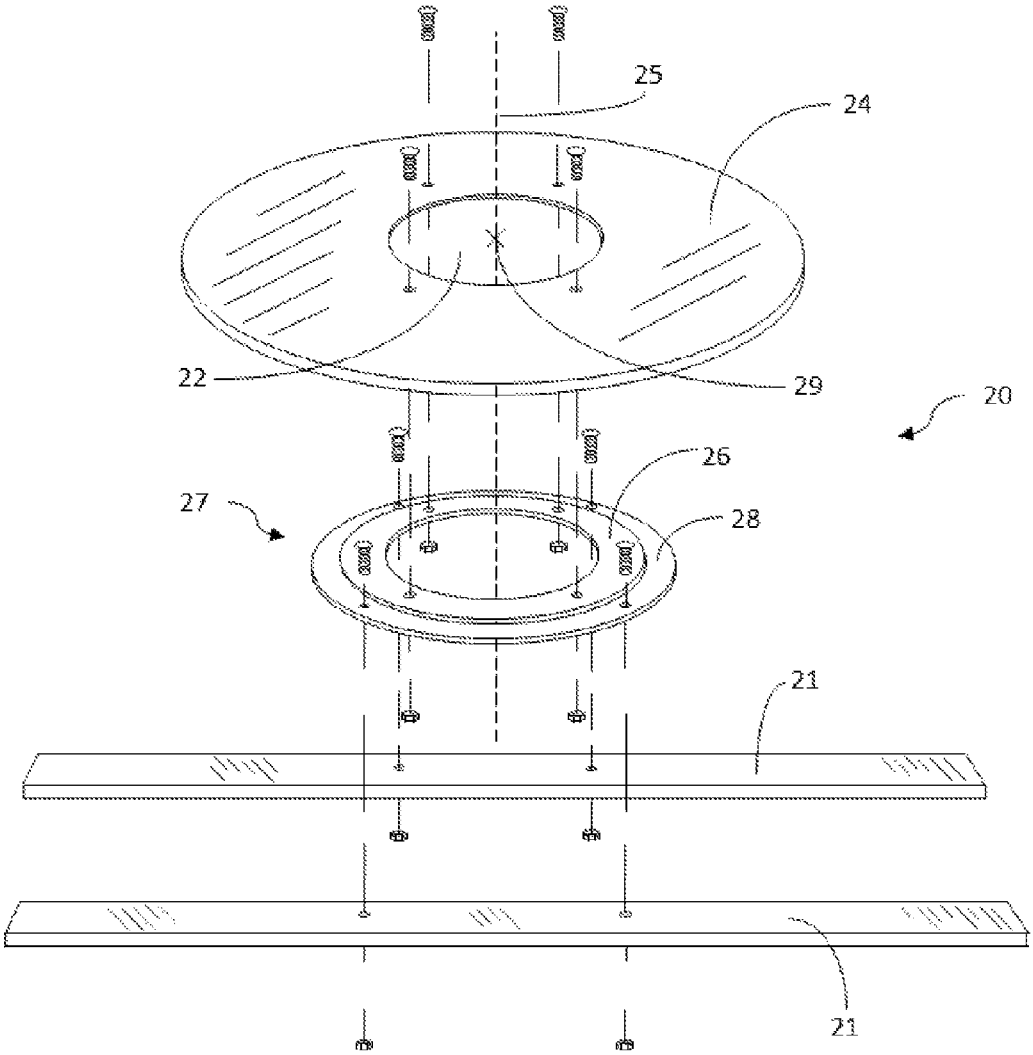
FIG. 3 is an exploded perspective view of at least a portion of apparatus according to one or more aspects of the present disclosure.

FIG. 3 is an exploded view of the rotatable seating member 20 shown in FIGS. 1 and 2. The seated partner sits on the upper surface 24 of the seating member 20. The upper surface 24 mounts to a first (e.g., inside) race 26 of a bearing assembly 27. The first race 26 rotates relative to a second (e.g., outside) race 28 about the substantially vertical rotational axis 25 aligned through the geometric center 29 of the opening 22. Rotation may be facilitated by way of ball bearings (not shown) that roll along a circular grove between the first race 26 and the second race 28 of the bearing assembly 27, perhaps in a manner common to lazy susan bearings, benchtop turntable bearings, pallet carousel bearings, and the like. The upper surface 24 may be of sufficient diameter to comfortably accommodate the seated partner and is equal to or larger than the diameter of the bearing assembly 27. The second race 28 may be mounted to the frame 21. Alternatively, one can assemble the seating member 20 such that the first race 26 mounts to the frame 21, and the second race 28 mounts to the upper surface 24. It can be appreciated by a person having ordinary skill in the art that other means exist to facilitate rotation of the seating member 20, and that such embodiments are considered to be included within the scope of the present disclosure. Some possibilities include rollers, casters, or other ball bearing assemblies.

Figure 4:
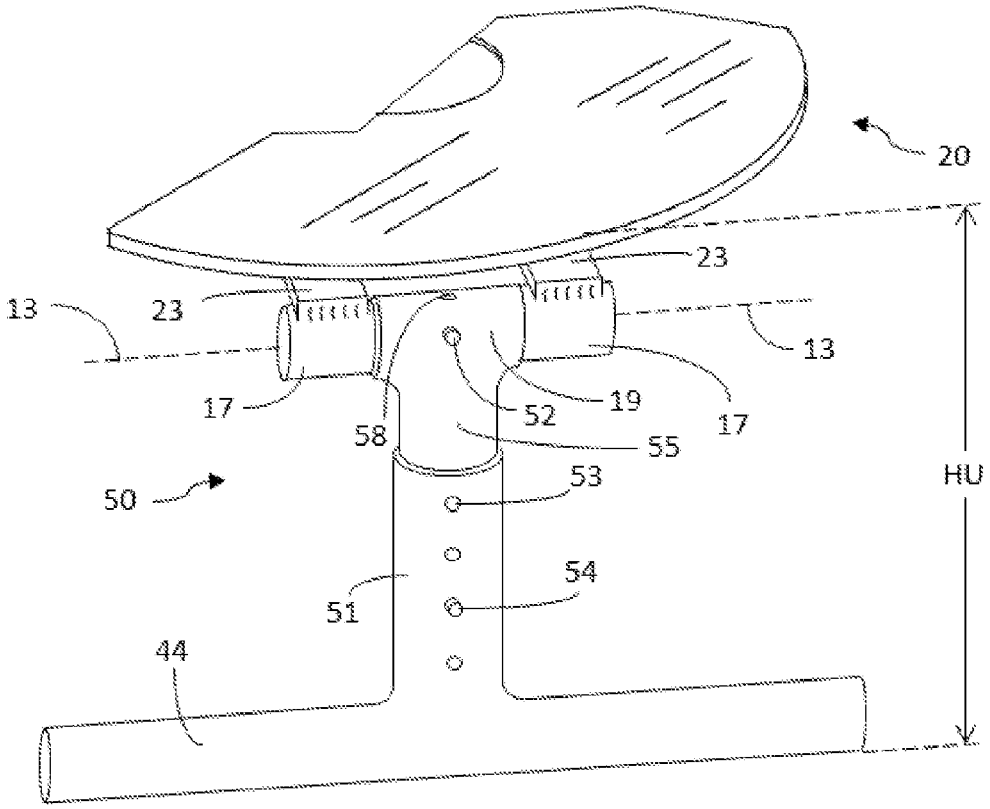
FIG. 4 is a perspective view of at least a portion of apparatus according to one or more aspects of the present disclosure.

FIG. 4 is a perspective view of another embodiment of the height adjustment and collapsibility mechanisms, collectively designated herein by reference numeral 50. The embodiment shown in FIG. 4 may be substantially similar to or otherwise have one or more aspects in common with the embodiment shown in FIGS. 1-3, except perhaps as described below and/or shown in the figures.

The uncollapsed height HU may be adjusted by means of a cylindrical tubing upper member 55 that may slide up or down within a larger diameter cylindrical tubing lower member 51. The lower member 51 may be temporarily locked at a particular height with respect to the upper member 55 by means of a spring-loaded pin 54 attached to the upper member 55 that may fit into one of several slots and/or other openings 53, which may be substantially evenly spaced and aligned (e.g., vertically) along the lower member 51. By depressing the spring-loaded pin 54 inside of the lower member 51 so that the spring-loaded pin 54 no longer contacts the opening 53, the lower member 51 may be telescopically translated to another position along the upper member 55, where the spring-loaded pin 54 may fit into another opening 53. A similar configuration may also be achieved in which the lower member 51 has smaller diameter than the upper member 55, such that the lower member 51 may slide within the upper member 55. Additionally, the lower member 51 and upper member 55 may not be cylindrical, such that their cross-sectional shapes may be non-circular but otherwise congruent, nesting, telescoping, etc., such that one of the upper member 55 or lower member 51 can slide axially within the other.

The bottom of the lower member 51 may be connected to a ground brace 44 that rests on the ground lateral to the man's hips as he lies in a supine position. The ground braces 44 may be oriented to be substantially parallel to at least one of the first or second axes 13. The shape, size, texture, and surface material of the ground brace 44 may be selected to increase friction and stability relative to the ground.

The end of the upper member 55 opposite to the spring-loaded pin 54 may be permanently attached to or formed with a substantially perpendicular cylindrical tubing outer hinge piece 19 that may rotate around the smaller diameter cylindrical tubing inner hinge piece 17. The inner hinge piece 17 may be coupled to or form a portion of a frame 23, which may be substantially similar to, or at least share one or more aspects with, the frame 21 shown in FIGS. 1-3, except perhaps as described below and/or shown in the figures.

The upper member 55 may be locked into either the collapsed or uncollapsed position relative to the frame 23 by a spring-loaded hinge pin 52 attached to the inner hinge piece 17, which may fit into one of two hinge slots and/or other openings 58 that may be aligned substantially perpendicular to each other on the outer hinge piece 19. The spring-loaded hinge pin 52 may be depressed inside of the outer hinge piece 19 so that the spring-loaded pin 52 no longer contacts the hinge opening 58, and the outer hinge piece 19 may then be rotated to the alternate (collapsed or uncollapsed) position. In this configuration, the inner hinge piece 17 remains stationary while the outer hinge piece 19, upper member 55, lower member 51, and ground brace 44 can be rotated about the inner hinge piece 17 into a collapsed or uncollapsed position.

The inner hinge piece 17 may also be permanently attached to or formed with the frame 23 to support the rotatable seating member 20. Possible methods of attaching the inner hinge piece 17 to the frame 23 may include welding (as shown in FIG. 4), threaded fasteners, and/or other suitable means.

Figure 5:
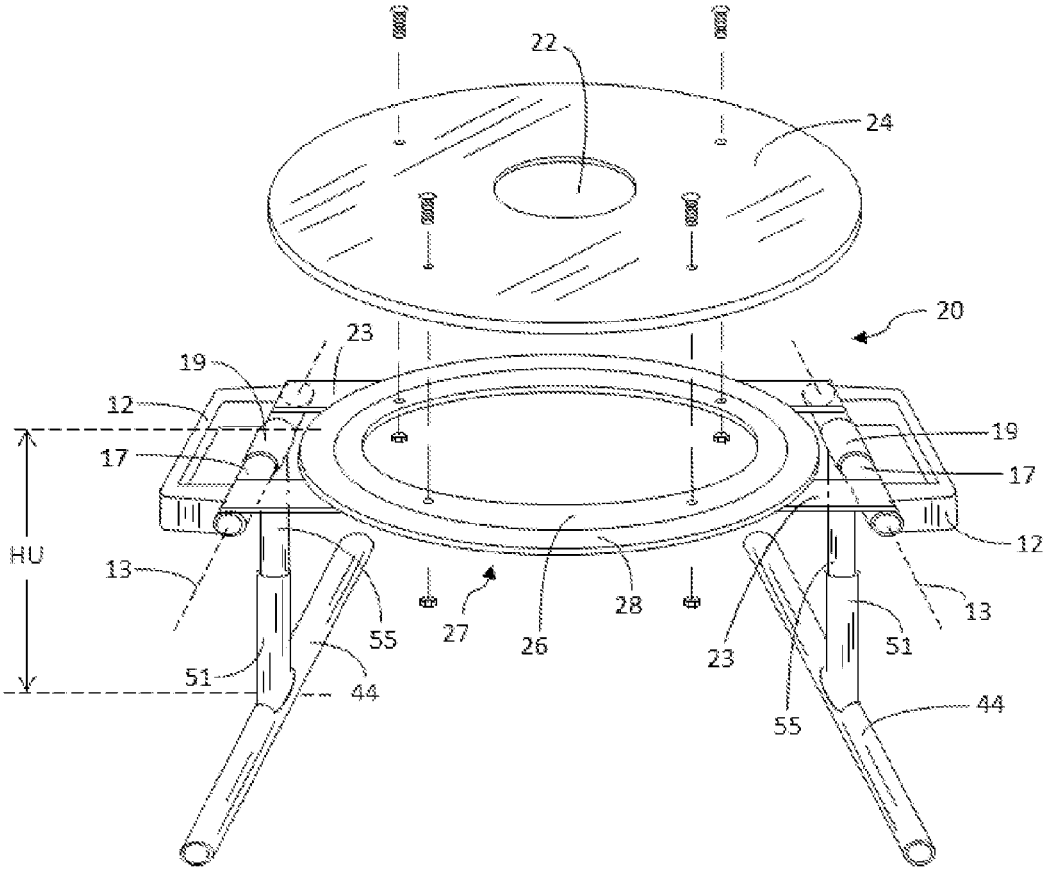
FIG. 5 is a perspective view of at least a portion of apparatus according to one or more aspects of the present disclosure.
Figure 6:
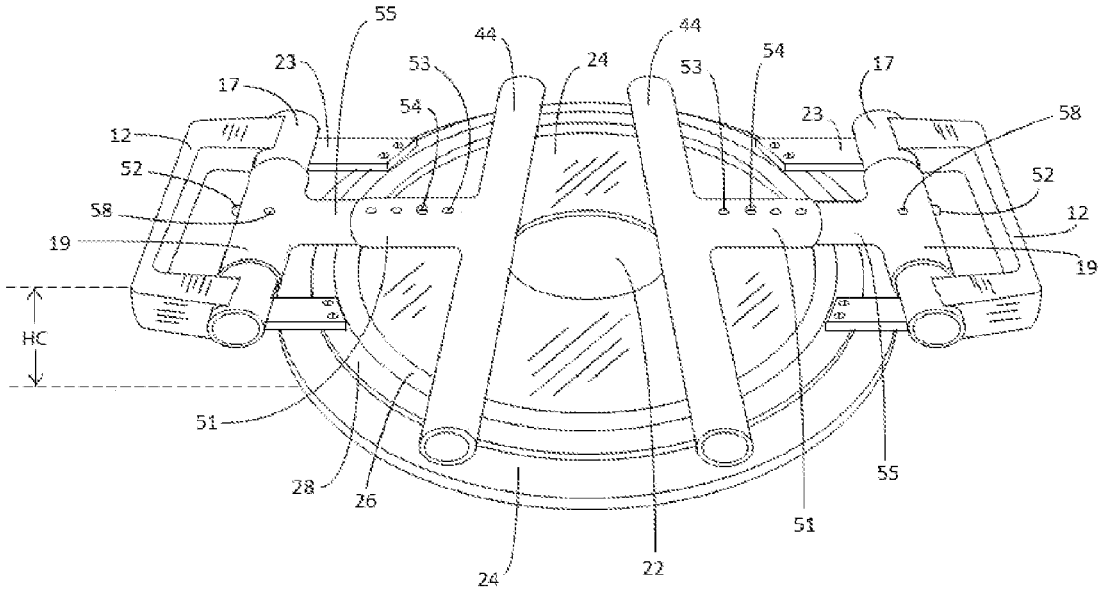
FIG. 6 is a perspective view of the apparatus shown in FIG. 5 in a collapsed position.

FIG. 5 is a partially exploded view of the apparatus shown in FIG. 4 in the uncollapsed position, and FIG. 6 is a perspective view of the apparatus shown in FIG. 4 in the collapsed position. The following discussion may refer to FIGS. 4-6, collectively.

As with the embodiment shown in FIGS. 1-3, the upper surface 24 of the seating member 20 has an opening 22 substantially centered within the upper surface 24 of the seating member 20. The upper surface 24 of the seating member 20 may be attached to a first (e.g., inside) race 26 of a bearing assembly 27 such that the upper surface 24 and seated partner may rotate relative to a second (e.g., outside) race 28 of the bearing assembly 27. The second race 28 may be attached to the frame 23, which is attached to the inner hinge pieces 17. With a sufficiently large second race 28, it may be possible to attach the second race 28 directly to the inner hinge pieces 17. This configuration might allow for greater strength, but the bearing assembly 27 would then need sufficient diameter to accommodate the medial/lateral dimension of the supine partner's torso.

First and second handles 12 may be attached to the stationary inner hinge pieces 17 or frame 23, which the seated partner may use to balance, to impart rotational motion, or to move up and down relative to the seating member 20. The first and second handles 12 may be positioned substantially below the upper surface 24 of the seating member 20 so as not to obstruct the path of the seated partner's legs or knees while the seating member 20 rotates. The first and second handles 12 may be utilized to carry the apparatus when not in use.

As best shown in FIG. 6, the collective height of the lower member 51 and the upper member 55 may be adjusted even in the collapsed position, such as by depressing the spring-loaded pin 54 and translating the lower member 51 until the spring-loaded pin 54 fits into another opening 53 along the lower member 51. By similar means, the spring-loaded hinge pin 52 may be depressed so that the upper member 55 may be lifted to rotate the outer hinge piece 19 until the spring-loaded hinge pin 52 fits into the hinge opening 58. As with the embodiment shown in FIGS. 1-3, when collapsed, at least one dimension of the apparatus 10 (e.g., collapsed height HC) may be reduced in size. In the collapsed configuration, the smallest dimension of the apparatus 10 (e.g., collapsed height HC) may range between about twenty centimeters and about five centimeters, or perhaps less, depending on the materials and configuration of components selected.

Figure 7:
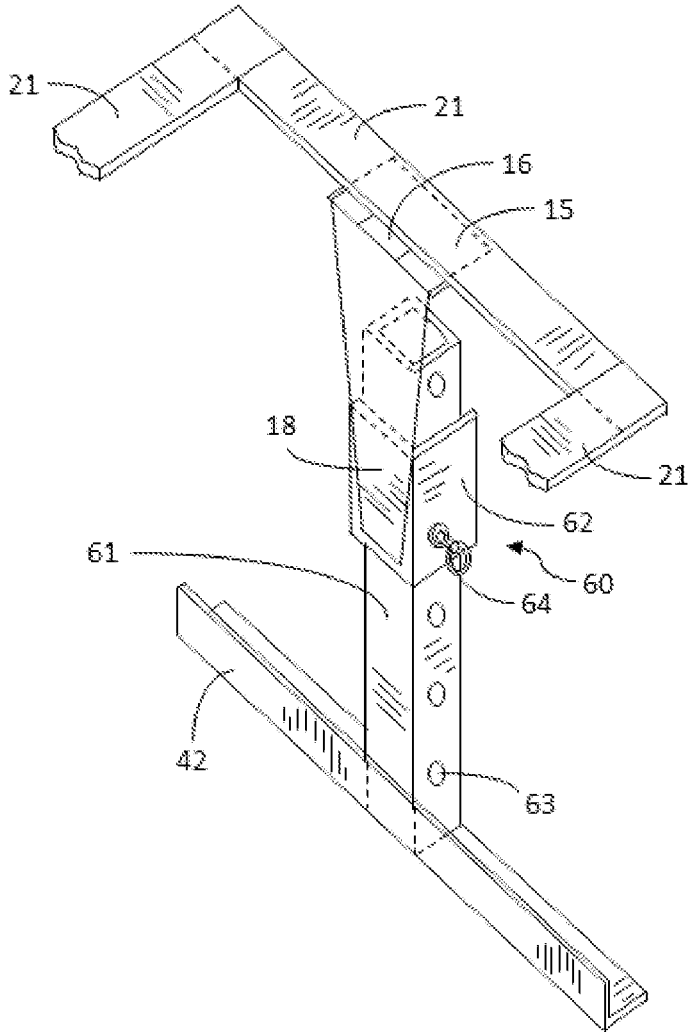
FIG. 7 is a perspective view of at least a portion of apparatus according to one or more aspects of the present disclosure.

FIG. 7 is a perspective view of at least a portion of another embodiment of the height adjustment mechanism 60 according to one or more aspects of the present disclosure. The embodiment shown in FIG. 7 may be substantially similar to or otherwise have one or more aspects in common with one or more of the embodiments shown in FIGS. 1-6, except perhaps as described below and/or shown in the figures.

An upper member 62 may slide up or down the lower member 61 to a desired height. The height adjustment mechanism 60 permits the upper member 62 to be positioned at one of several predetermined heights by means of a pin 64 that may slide through the upper member 62 and into one of several sockets 63, which may be substantially evenly spaced and aligned along the longitudinal axis of the lower member 61. The pin 64 may be or comprise a cottar pin, a detent pin, a clevis pin, a hitch pin, and/or other fasteners. The upper member 62 may be connected to the bottom of the lower hinge piece 18, as described in the embodiment shown in FIGS. 1 and 2. Similarly, the spacing of the sockets 63, the sizing of the lower member 61, and the connection of the lower member 61 to the ground brace 41 may be substantially similar and/or analogous to the embodiment shown in FIGS. 1 and 2.

Figure 8:
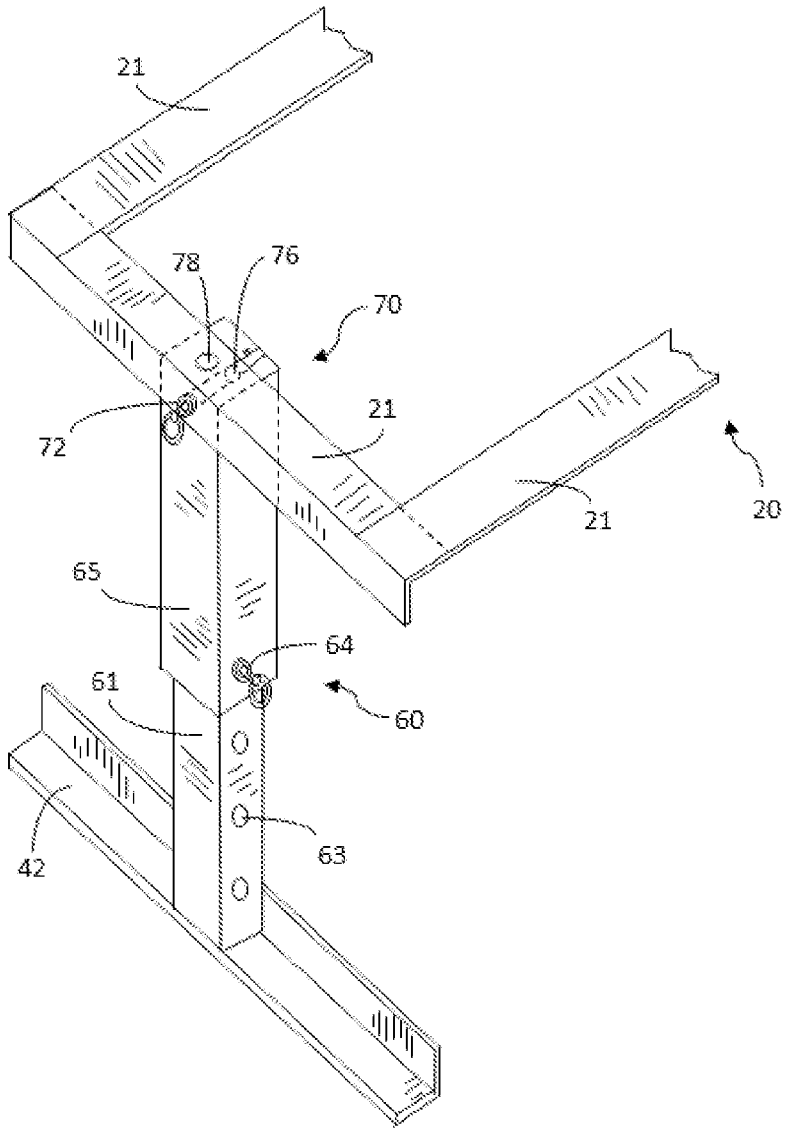
FIG. 8 is a perspective view of at least a portion of apparatus according to one or more aspects of the present disclosure.
Figure 9:
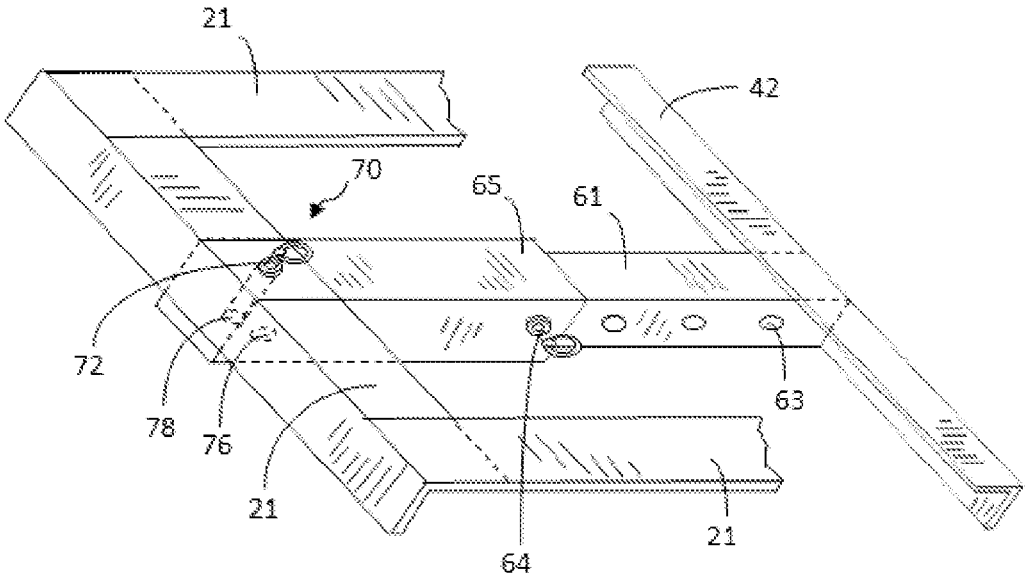
FIG. 9 is a perspective view of at least a portion of apparatus according to one or more aspects of the present disclosure.

FIGS. 8 and 9 are perspective views of a portion of another embodiment of the apparatus shown in FIGS. 1-7 according to one or more aspects of the present disclosure. The apparatus is shown in the uncollapsed position in FIG. 8, and in the collapsed position in FIG. 9. The embodiment shown in FIGS. 8 and 9 may be substantially similar to or otherwise have one or more aspects in common with one or more of the embodiments shown in FIGS. 1-7, except perhaps as described below and/or shown in the figures.

As shown in FIG. 8, a pin 72 is positioned in a socket and/or other opening 76 that mates the upper portion of the upper member 65 to the substantially vertical surface of the frame 21 when the apparatus is in the uncollapsed position. In the collapsed position, shown in FIG. 9, the pin 72 is positioned in another opening 78 that mates the upper portion of the upper member 65 to the frame 21. To ensure stability of the pin and socket connection, two pins 72 may be permanently mounted to the frame 21 in the collapsed and uncollapsed positions, such that either of the pins 72 may be positioned in the corresponding opening 76/78 on the upper portion of the upper member 65, which may reduce or eliminate motion of the pins 72 relative to the frame 21.

Figure 10:
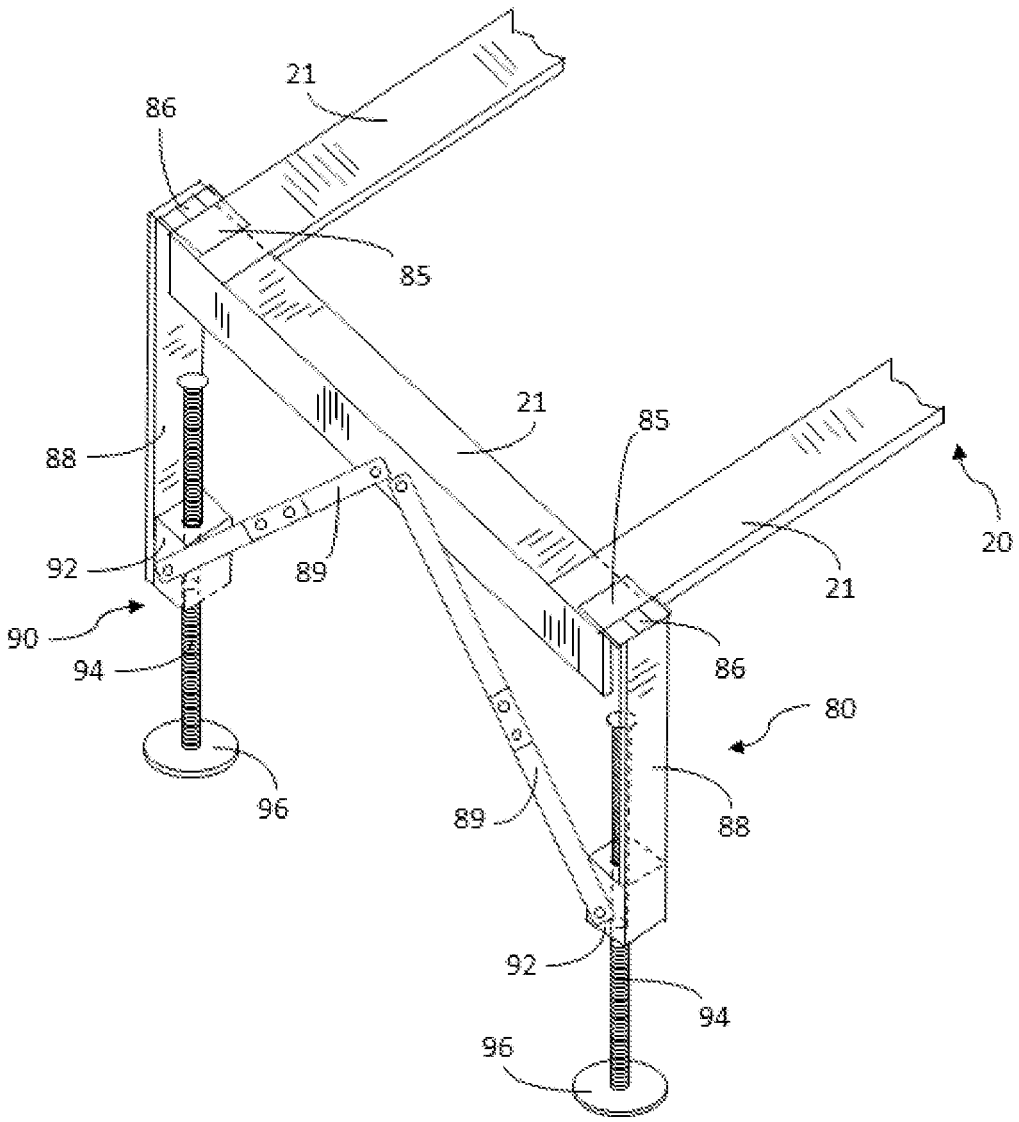
FIG. 10 is a perspective view of at least a portion of apparatus according to one or more aspects of the present disclosure.

FIG. 10 is a perspective view of a portion of another embodiment of the apparatus shown in FIGS. 1-9 according to one or more aspects of the present disclosure, depicting an alternate means of collapsibility and height adjustment. The embodiment shown in FIG. 10 may be substantially similar to or otherwise have one or more aspects in common with one or more of the embodiments shown in FIGS. 1-9, except perhaps as described below and/or shown in the figures.

As partially shown in FIG. 10, four leg components 80 may each be connected to a corresponding corner of the frame 21. The height of the leg components 80 may be adjusted via a threaded bolt assembly 90. Each corner of the frame 21 may also connect to an upper hinge piece 85. The center pivoting piece 86 of the hinge permits a lower hinge piece 88 and the leg component 80 to be folded under the seating member 20, such as for storage and/or portability. A spreader brace 89 may connect the lower portion of the lower hinge piece 88 to the frame 21. The spreader brace 89 may be folded when the leg component 80 is collapsed and may lock when the leg component 80 is fully extended, such as to keep the leg component 80 in an upright position when the apparatus is in use.

The lower hinge piece 88 may be about fifteen centimeters long and may include a nut 92 at or near the end opposite the center pivoting piece 86. The nut 92 may be oriented such that the inner-threaded channel may be substantially parallel to the long dimension of the lower hinge piece 88. The height of the nut 92 may range from less than about three centimeters to the full length of the lower hinge piece 88. A longer length of the nut 92 may increase stability of the leg component 80 in some embodiments. A bolt 94, which may have a minimum length of about fifteen centimeters, may be threaded through the nut 92 such that relative rotation thereof may adjust the height of the leg component 80. A foot piece 96 may be attached at the bottom of the threaded bolt 94 to contact the ground in the uncollapsed position. The shape, size, texture, and surface material of the foot piece 96 may be designed to increase friction and stability relative to the ground.

Figure 11:
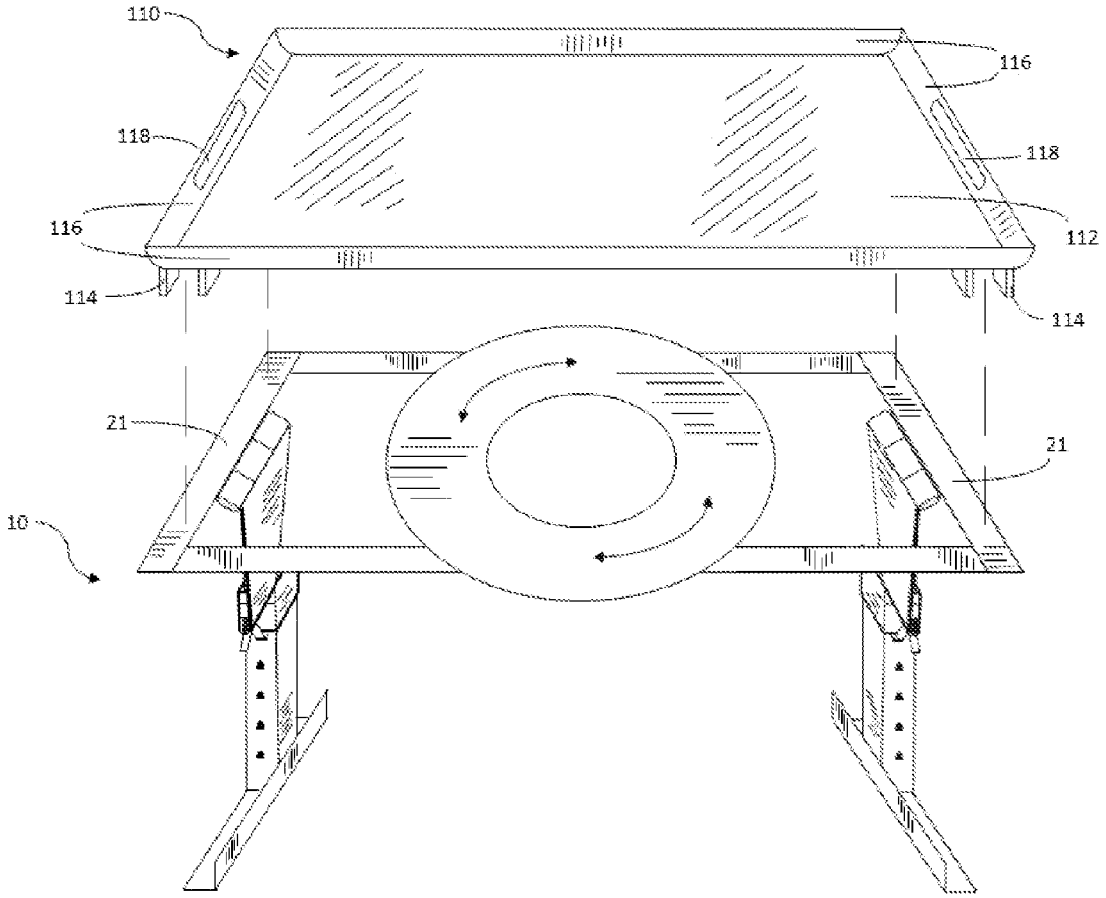
FIG. 11 is a perspective view of at least a portion of apparatus according to one or more aspects of the present disclosure.

FIG. 11 is a perspective view of a portion of another embodiment of the apparatus shown in FIGS. 1-10 according to one or more aspects of the present disclosure. The embodiment shown in FIG. 11 may be substantially similar to or otherwise have one or more aspects in common with one or more of the embodiments shown in FIGS. 1-10, except perhaps as described below and/or shown in the figures.

For example, FIG. 11 depicts the apparatus 10 shown in FIG. 1, but with the addition of an optional accessory resembling or comprising a tray 110. Tray brackets 114 located on the bottom of the tray 110 may slide onto the frame 21 of the apparatus 10 to keep the tray 110 situated atop the apparatus 10. A person having ordinary skill in the art will recognize, however, that myriad other ways exist for fastening the tray 110 to the apparatus 10 within the scope of the present disclosure.

The tray 110 may include a flat, rectangular surface area 112 that may be used as a lap table for food and drink, as a lap desk for writing, as a laptop computer rest, or other household uses that may not necessarily be traditionally associated with sexual activity. The tray 110 may include raised sides 116, such as may aid in preventing articles from sliding or rolling off the flat surface area 112. The raised sides 116 may include handles 118 for carrying the tray 110 when detached from the apparatus 10. The tray 110 may be constructed of wood, plastic, or any other rigid and perhaps lightweight material.

Figure 12:
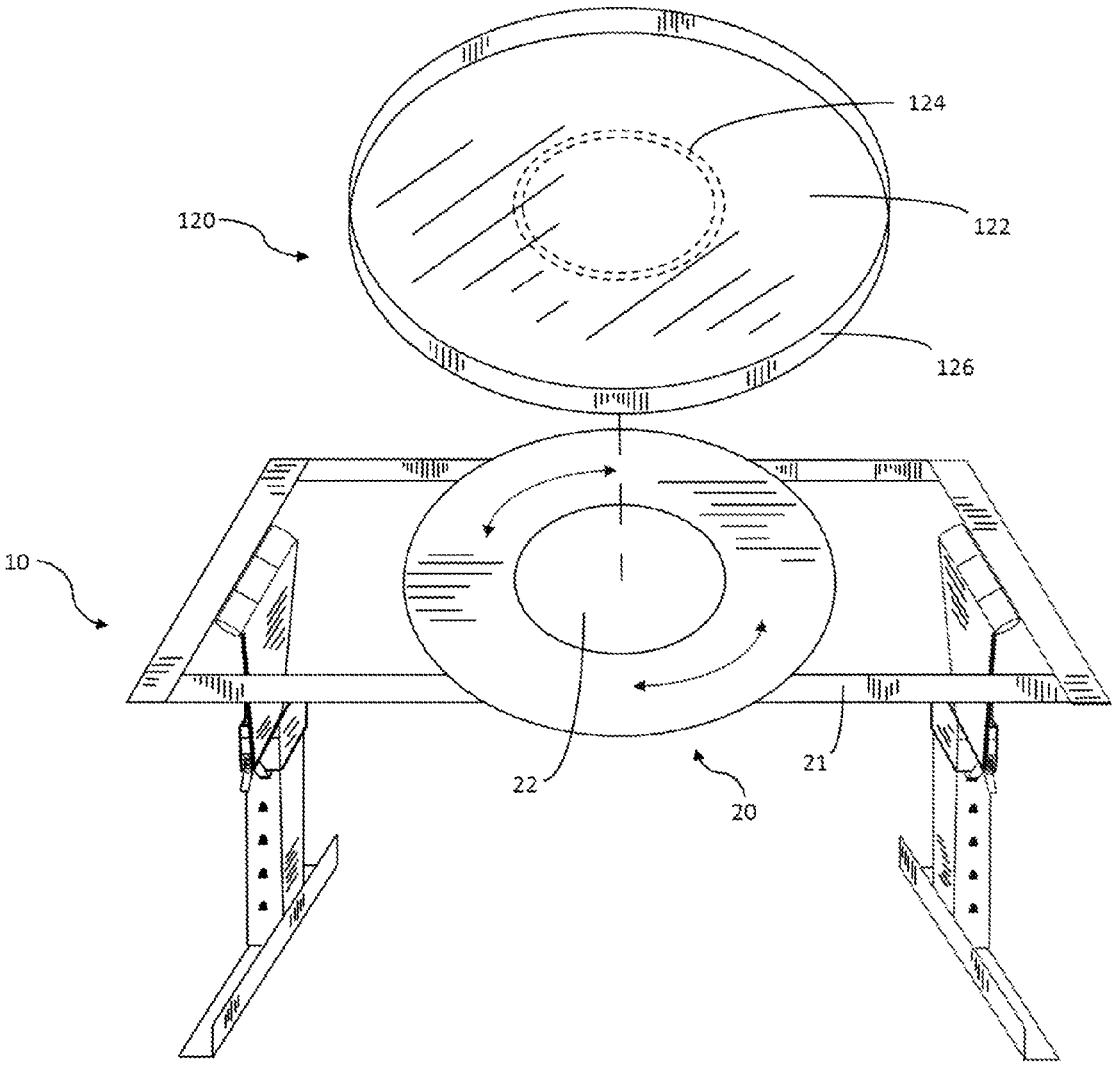
FIG. 12 is a perspective view of at least a portion of apparatus according to one or more aspects of the present disclosure.

FIG. 12 is a perspective view of a portion of another embodiment of the apparatus shown in FIGS. 1-11 according to one or more aspects of the present disclosure. The embodiment shown in FIG. 12 may be substantially similar to or otherwise have one or more aspects in common with one or more of the embodiments shown in FIGS. 1-11, except perhaps as described below and/or shown in the figures.

For example, FIG. 12 depicts the apparatus 10 from FIG. 1, but with the addition of an optional accessory resembling or comprising a circular tray 120. The circular tray 120 includes a flat, circular surface area 122. Raised sides 126 may aid in preventing articles from sliding or rolling off the flat surface area 122.

The circular tray 120 may include a circular convex groove 124 that can mate with the opening 22 of the apparatus 10, such as to keep the circular tray 120 situated atop the apparatus 10. By mating the circular tray 120 to the seating member 20, the circular tray 120 may be rotated with respect to the frame 21. This may be desirable in the same way a common lazy susan is used to reach food more easily, such as by slowly spinning the table surface so that the desired item is nearer to reach. The circular tray 120 may be constructed of wood, plastic, or any other rigid, perhaps lightweight material. A person having ordinary skill in the art may appreciate other ways to fasten the circular tray 120 to the apparatus 10, as well as other types of covers or accessories to conceal the apparatus' purpose as a sexual device. Any such design is considered to also be within the scope of the present disclosure.

Figure 13:
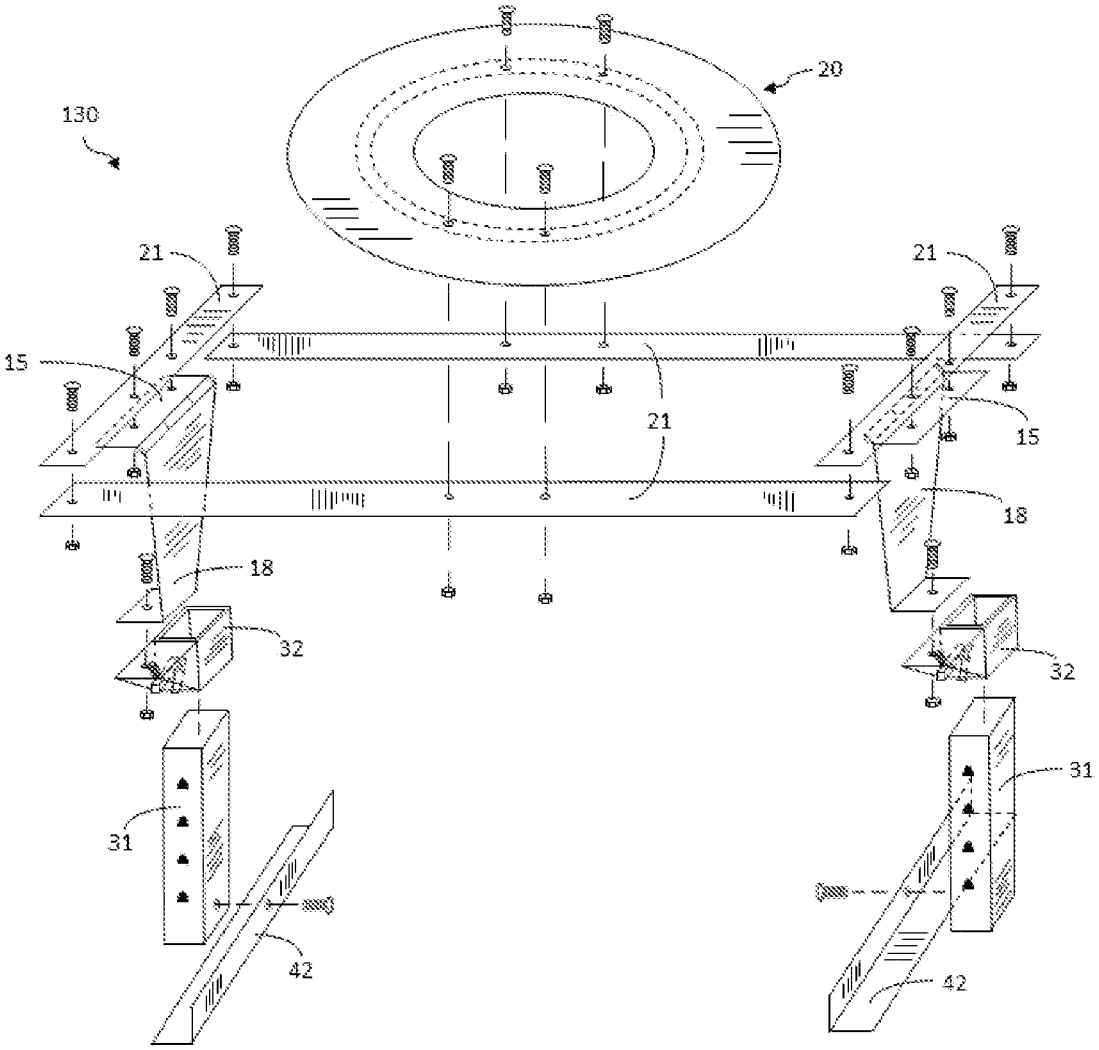
FIG. 13 is a perspective view of at least a portion of a method according to one or more aspects of the present disclosure.

FIG. 13 is an exploded perspective view of a kit 130 according to one or more aspects of the present disclosure. The kit 130 comprises the components of the apparatus 10 shown in FIGS. 1-3. The kit 130 may also or alternatively comprise one or more components of the apparatus shown in one or more of FIGS. 4-12. The kit 130 may be used during a method of assembly, such that various components and subcomponents of the disclosed apparatus may be packaged more compactly and put together by an end user rather than by a manufacturer or retailer. The components depicted in FIG. 13 are being connected via nuts and bolts, but other suitable means of attachment should also be considered to be included within the scope of the present disclosure.

As shown in FIG. 13, the rotatable seating member 20 may be attached to the frame 21. On each side of the frame 21, there may be connected first and second supports 40. The upper members 32 of the first and second supports 40 may be attached to lower hinge pieces 18, which may be rotatably coupled to the upper hinge pieces 15 and frame 21 via center pivoting pieces 16. For each of the first and second supports 40, the lower hinge piece 18 may connect to an upper member 32. The lower member 31 may slide into the upper member 32. The opposing side of the lower member 31 may attach to a ground brace 42.

In view of the entirety of the present disclosure, including the figures, a person having ordinary skill in the art should readily recognize that the present disclosure introduces apparatus and methods relating to a sexual aid that may enhance pleasure and/or introduce variety by permitting rotary motion of a seated partner relative to a supine partner positioned under the apparatus. The apparatus may also permit the weight of the seated partner to be supported by the apparatus rather than the supine partner, which some partners may find more comfortable than traditional sexual positions. The uncollapsed height of the seating member over the ground and, hence, the supine partner, may be adjusted, and the legs are collapsible for storage during non-use. A cover may be used in conjunction with the disclosed apparatus as a means of discrete concealment and/or to facilitate alternate use as, for example, a lap desk, breakfast in bed stand, TV stand, or other common household item which may not traditionally be associated with sexual activity.

Embodiments introduced herein may include a seating member with an annular-shaped surface that can be rotated in a substantially horizontal plane about a substantially vertical axis. The seating member may be rotated by means of rollers, casters, ball bearings, and/or other suitable means. The rotational mechanism may employ a lazy susan bearing. The seating member may be supported by a rigid frame and legs, which may offer sufficient clearance beneath the seating member to accommodate the lower trunk of the supine partner. The seating member may be padded for comfort. The rigid frame may include handles that the seated partner may use to impart rotation, or to move up and down relative to the seating member. The handles may also be useful to carry the disclosed device when not in use.

The legs of the apparatus introduced herein may be adjusted so as to achieve a desired uncollapsed height of the apparatus. Numerous mechanisms may be employed to adjust the height. Possible mechanisms for height adjustment include but are not limited to: a sliding assembly with a pin and socket, a threaded bolt assembly, and a sliding assembly with a spring-loaded tab that fits into regularly spaced openings. The bottom of the legs may employ shape, size, texture, and/or gripping material that may increase stability of the disclosed apparatus relative to the ground.

The apparatus introduced herein are collapsible so as to facilitate storage and/or conceal the apparatus when not in use. For example, the legs of the apparatus may be folded underneath the frame into a collapsed position by means of rotational coupling to the frame. Alternatively, or additionally, the legs may be detached from the frame for storage or transport. The legs may be lockable in one or both of the uncollapsed and collapsed positions, such as may stabilize the frame relative to the legs.

Another means of concealing the apparatus involves the use of a cover that partially, substantially, or entirely conceals from view the fact that the apparatus is a sexual-oriented device. For example, the cover may be configured such that the apparatus appears to be a lap desk, TV tray, breakfast in bed stand, and/or other regular household item not traditionally appearing to be sexually oriented in nature. Such devices may comprise a flat surface area supported by collapsible legs that can be positioned such that the flat surface area rests over a person's lap while seated or in a supine position. Of course, other configurations in which the apparatus is designed to aesthetically resemble products other than sexual devices, even if not explicitly listed above, are also considered to be within the scope of the present disclosure. The cover may be attached to the rigid frame of the apparatus, or it may be connected to the rotatable seating member. By attaching the cover to the seating member, the cover may also be rotated relative to the rigid frame, which may be desirable when in use as, for example, a table surface for eating, among the myriad other uses within the scope of the present disclosure. The cover may be rectangular or circular in shape, although other embodiments within the scope of the present disclosure may alternatively have other shapes.

The present disclosure also introduces a kit comprising components of one or more of the embodiments within the scope of the present disclosure. For example, an end user may assemble such components to achieve one or more of the embodiments depicted in one or more of FIGS. 1-13 or otherwise within the scope of the present disclosure.

The present disclosure also introduces an apparatus comprising: a frame; a first support rotatably coupled to the frame and rotatable around a first axis; a second support rotatably coupled to the frame and rotatable around a second axis; and a seating member rotatably coupled to the frame and rotatable around a third axis that is non-parallel to at least one of the first and second axes, wherein the seating member comprises an opening through which the third axis extends. The first and second supports may be rotatably coupled to opposing sides of the frame. At least a portion of the opening may have a diameter that is less than about thirty centimeters, less than about twenty centimeters, less than about fifteen centimeters, less than about ten centimeters, less than about eight centimeters, or less than about six centimeters.

The opening may be substantially circular. The third axis may be substantially aligned with a geometric center of the opening.

The seating member may have a substantially U-shaped footprint.

The first and second axes may be substantially parallel.

The third axis may be substantially perpendicular to the first and second axes.

The first and second supports may each comprise a telescopic portion.

The apparatus may further comprise a bearing rotatably coupling the seating member and the frame.

The apparatus may further comprise: a first handle coupled to at least one of the frame and the first support; and a second handle coupled to at least one of the frame and the second support. The first and second handles may be disposed on opposite sides of the frame. The seating member may be rotatable relative to the first and second handles. A geometric plane substantially parallel with the frame may interpose the seating member and the first and second handles.

The apparatus may be configurable between a collapsed configuration and an uncollapsed configuration via rotation of the first and second supports relative to the frame. At least one dimension of a volume enveloping the apparatus in the collapsed configuration may be less than about twenty centimeters, less than about fifteen centimeters, less than about ten centimeters, or less than about five centimeters.

The first and second supports may each comprise upper and lower telescoping members, and the upper member of each of the first and second supports may be rotatably coupled to the frame. For each of the first and second supports, the lower member may include: a first portion operable to telescope relative to the upper member; and a second portion extending substantially perpendicular to the first portion and substantially parallel to the corresponding one of the first and second axes. For each of the first and second supports, the upper and lower members may comprise one or more tubular members. The one or more tubular members may each have a substantially circular cross-sectional shape.

The present disclosure also introduces a method comprising: rotating a first support around a first axis, wherein the first support is rotatably coupled to a frame; rotating a second support around a second axis, wherein the second support is rotatably coupled to the frame; and rotating a seating member around a third axis that is substantially non-parallel to at least one of the first and second axes, wherein the seating member is rotatably coupled to the frame and comprises an opening through which the third axis extends.

The method may further comprise positioning the rotated first and second supports on a surface that is generally horizontal, thereby supporting the frame and seating member above and substantially parallel to the surface. The method may further comprise adjusting a height of the frame and seating member over the surface. Adjusting the height may comprise adjusting a first length of the first support and a second length of the second support. The first support may comprise a first upper member and a first lower member, the second support may comprise a second upper member and a second lower member, adjusting the first length of the first support may comprise telescoping the first upper member relative to the first lower member, and adjusting the second length of the second support may comprise telescoping the second upper member relative to the second lower member.

Rotating the first support may comprise rotating the first support away from the frame, rotating the second support may comprise rotating the second support away from the frame, and the method may further comprise collapsing the first and second supports by rotating the first and second supports towards the frame.

The present disclosure also introduces a method comprising: rotatably coupling a first support to a frame such that the first support is rotatable around a first axis; rotatably coupling a second support to the frame such that the second support is rotatable around a second axis; and rotatably coupling a seating member to the frame such that the seating member is rotatable around a third axis that is substantially non-parallel to at least one of the first and second axes, and such that the third axis extends through an opening in the seating member.

Rotatably coupling the first and second supports to the frame may comprise coupling them on opposing sides of the frame.

Rotatably coupling the seating member to the frame may comprise: coupling the seating member to a first race of a rotary bearing; and coupling the frame to a second race of the rotary bearing.

The method may further comprise: coupling a first handle to at least one of the frame and the first support; and coupling a second handle to at least one of the frame and the second support.

The first support may comprise first upper and lower telescoping members, the second support may comprise second upper and lower telescoping members, rotatably coupling the first support to the frame may comprise rotatably coupling the first upper telescoping member to the frame, and rotatably coupling the second support to the frame may comprise rotatably coupling the second upper telescoping member to the frame.

The present disclosure also introduces a method comprising: positioning an apparatus on a surface that is substantially horizontal, wherein the apparatus comprises: a first support rotatably coupled to a frame and rotatable around a first axis; a second support rotatably coupled to the frame and rotatable around a second axis; and a seating member supported over the surface by the frame and the first and second supports, wherein the seating member is rotatably coupled to the frame and rotatable around a third axis that is substantially non-parallel to at least one of the first and second axes, and wherein the seating member comprises an opening through which the third axis extends; positioning a first live human body on the surface; positioning the apparatus over the first live human body such that a portion thereof extends through the opening; positioning a second live human body on the seating member such that an orifice of the second live human body receives the first live human body portion extending through the opening; and rotating the seating member relative to the frame while the orifice is in receipt of the first live human body portion extending through the opening.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A collapsible, rotating seat apparatus, comprising:

a frame;

a first support rotatably coupled to the frame and rotatable around a first axis;

a second support rotatably coupled to the frame and rotatable around a second axis;

a circular bearing assembly attached to the frame; and a circular seating member rotatably coupled to the frame by the bearing assembly and rotatable around a third axis that is non-parallel to at least one of the first and second axes, wherein an opening extends through the frame, the bearing assembly, and the seating member, wherein the third axis extends through the opening, and wherein the bearing assembly comprises a first race attached to the frame and a second race attached to the seating member.

2. The collapsible, rotating seat apparatus of claim 1 wherein the first and second supports are rotatably coupled to opposing sides of the frame.

3. The collapsible, rotating seat apparatus of claim 1 wherein the opening is substantially circular.

4. The collapsible, rotating seat apparatus of claim 3 wherein the third axis is substantially aligned with a geometric center of the opening.

5. The collapsible, rotating seat apparatus of claim 1 wherein the first and second axes are substantially parallel.

6. The collapsible, rotating seat apparatus of claim 1 wherein the third axis is substantially perpendicular to the first and second axes.

7. The collapsible, rotating seat apparatus of claim 1 further comprising:

a first handle coupled to at least one of the frame and the first support; and a second handle coupled to at least one of the frame and the second support;

wherein the seating member is rotatable relative to the first and second handles.

8. The collapsible, rotating seat apparatus of claim 7 wherein a geometric plane substantially parallel with the frame interposes the seating member and the first and second handles.

9. The collapsible, rotating seat apparatus of claim 1 wherein the apparatus is configurable between a collapsed configuration and an uncollapsed configuration via rotation of the first and second supports relative to the frame.

10. The collapsible, rotating seat apparatus of claim 1 wherein the first and second supports each comprise upper and lower telescoping members, wherein the upper member of each of the first and second supports is rotatably coupled to the frame.

11. The collapsible, rotating seat apparatus of claim 10 wherein, for each of the first and second supports, the lower member includes:

a first portion operable to telescope relative to the upper member; and a second portion extending substantially perpendicular to the first portion and substantially parallel to the corresponding one of the first and second axes.

12. The collapsible, rotating seat apparatus of claim 1 further comprising a cover coupled to at least one of the frame and the seating member.

13. A method, comprising:

rotating a first support around a first axis, wherein the first support is rotatably coupled to a frame;

rotating a second support around a second axis, wherein the second support is rotatably coupled to the frame; and rotating a seating member around a third axis that is substantially non-parallel to at least one of the first and second axes, wherein the seating member is rotatably coupled to the frame by a circular bearing assembly comprising a first race attached to the frame and a second race attached to the seating member, wherein an opening extends through the frame, the bearing assembly, and the seating member, and wherein the third axis extends through the opening.

14. The method of claim 13 further comprising:

positioning the rotated first and second supports on a surface that is generally horizontal, thereby supporting the frame and seating member above and substantially parallel to the surface; and adjusting a height of the frame and seating member over the surface.

15. The method of claim 14 wherein adjusting the height comprises adjusting a first length of the first support and a second length of the second support.

16. The method of claim 15 wherein:

the first support comprises a first upper member and a first lower member;

the second support comprises a second upper member and a second lower member;

adjusting the first length of the first support comprises telescoping the first upper member relative to the first lower member; and adjusting the second length of the second support comprises telescoping the second upper member relative to the second lower member.

17. A method, comprising:

rotatably coupling a first support to a frame such that the first support is rotatable around a first axis;

rotatably coupling a second support to the frame such that the second support is rotatable around a second axis; and rotatably coupling a seating member to the frame, by coupling a first race of a circular bearing assembly to the seating member and coupling a second race of the bearing assembly to the frame, such that the seating member is rotatable around a third axis that is substantially non-parallel to at least one of the first and second axes, and such that the third axis extends through an opening that extends through the frame, the bearing assembly, and the seating member.

18. The method of claim 17 wherein:

the first support comprises first upper and lower telescoping members;

the second support comprises second upper and lower telescoping members;

rotatably coupling the first support to the frame comprises rotatably coupling the first upper telescoping member to the frame; and rotatably coupling the second support to the frame comprises rotatably coupling the second upper telescoping member to the frame.

* * * * *